US008910716B2

(12) United States Patent
Newton et al.

(10) Patent No.: US 8,910,716 B2
(45) Date of Patent: Dec. 16, 2014

(54) APPARATUS AND METHOD FOR CONTROLLING FLUID FLOW FROM A FORMATION

(75) Inventors: Daniel Newton, Jakarta (ID); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 350 days.

(21) Appl. No.: 12/969,899

(22) Filed: Dec. 16, 2010

(65) Prior Publication Data

US 2012/0152562 A1 Jun. 21, 2012

(51) Int. Cl.
*E21B 43/12* (2006.01)
*E21B 33/12* (2006.01)
*E21B 34/14* (2006.01)

(52) U.S. Cl.
CPC ..... *E21B 43/12* (2013.01)
USPC ..... 166/373; 166/386; 166/191; 166/65.1

(58) Field of Classification Search
USPC ..... 166/385, 386, 373, 316, 65.1, 191, 313, 166/332.4, 245, 50, 66.6
See application file for complete search history.

(56) References Cited

U.S. PATENT DOCUMENTS 5,265,679 A 11/1993 Coronado et al.
5,896,928 A 4/1999 Coon
5,957,207 A 9/1999 Schnatzmeyer
6,112,815 A 9/2000 Boe et al.
6,112,817 A 9/2000 Voll et al.
6,220,357 B1 4/2001 Carmichael et al.
6,360,820 B1 * 3/2002 Laborde et al. ..... 166/66
6,478,087 B2 11/2002 Allen
6,527,052 B2 3/2003 Ringgenberg et al.
6,622,794 B2 9/2003 Zisk, Jr.
6,684,952 B2 * 2/2004 Brockman et al. ..... 166/250.03
6,768,700 B2 * 7/2004 Veneruso et al. ..... 367/81
6,896,056 B2 5/2005 Mendez et al.
6,973,974 B2 12/2005 McLoughlin et al.
7,168,493 B2 1/2007 Eddison
7,243,723 B2 * 7/2007 Surjaatmadja et al. ..... 166/278
7,290,606 B2 11/2007 Coronado et al.
7,336,199 B2 2/2008 Lasater et al.
7,377,327 B2 5/2008 Jackson
7,387,165 B2 * 6/2008 Lopez de Cardenas et al. ..... 166/313
7,419,002 B2 9/2008 Dybevik et al.
7,802,627 B2 * 9/2010 Hofman et al. ..... 166/386
7,918,272 B2 4/2011 Gaudette et al.
7,934,553 B2 * 5/2011 Malone ..... 166/278
7,971,646 B2 * 7/2011 Murray et al. ..... 166/332.4

(Continued)

OTHER PUBLICATIONS

International Search Report and Written Opinion dated Jul. 24, 2012 for International Application No. PCT/US2011/062644.

(Continued)

*Primary Examiner* — Kenneth L Thompson
(74) *Attorney, Agent, or Firm* — Cantor Colburn LLP

(57) ABSTRACT

In one aspect, an apparatus for controlling fluid flow between a formation and a tubular is provided, wherein the apparatus includes a retrievable communication device configured to be conveyed to a selected location in the tubular downhole. The apparatus also includes a control node configured to communicate with the retrievable communication device at the selected location, a flow control device coupled to and controlled by the control node and a sensor coupled to the control node, wherein the sensor and flow control device are downhole of the control node.

20 Claims, 2 Drawing Sheets

(56) References Cited

U.S. PATENT DOCUMENTS

| | | | | |
|---|---|---|---|---|
| 2002/0003038 | A1 | 1/2002 | Bussear et al. | |
| 2002/0018399 | A1* | 2/2002 | Schultz et al. | 367/81 |
| 2002/0189815 | A1 | 12/2002 | Johnson et al. | |
| 2003/0066652 | A1 | 4/2003 | Stegemeier et al. | |
| 2003/0164240 | A1* | 9/2003 | Vinegar et al. | 166/372 |
| 2006/0113089 | A1 | 6/2006 | Henriksen et al. | |
| 2007/0246210 | A1 | 10/2007 | Richards | |
| 2007/0246212 | A1 | 10/2007 | Richards | |
| 2007/0246213 | A1 | 10/2007 | Hailey, Jr. | |
| 2007/0246407 | A1 | 10/2007 | Richards et al. | |
| 2007/0272408 | A1 | 11/2007 | Zazovsky et al. | |
| 2008/0041576 | A1* | 2/2008 | Patel et al. | 166/65.1 |
| 2008/0041580 | A1 | 2/2008 | Freyer et al. | |
| 2008/0041581 | A1 | 2/2008 | Richards | |
| 2008/0041586 | A1 | 2/2008 | Eken | |
| 2008/0041588 | A1 | 2/2008 | Richards et al. | |
| 2008/0047709 | A1 | 2/2008 | Tremblay et al. | |
| 2008/0135255 | A1 | 6/2008 | Coronado et al. | |
| 2008/0231467 | A1* | 9/2008 | Jeffryes | 340/854.3 |
| 2008/0314590 | A1 | 12/2008 | Patel | |
| 2009/0065195 | A1 | 3/2009 | Chalker et al. | |
| 2009/0095487 | A1 | 4/2009 | Xu et al. | |
| 2009/0139728 | A1 | 6/2009 | Schrader et al. | |
| 2009/0151925 | A1 | 6/2009 | Richards et al. | |
| 2009/0159275 | A1 | 6/2009 | Kannan et al. | |
| 2009/0205834 | A1 | 8/2009 | Garcia et al. | |
| 2009/0236102 | A1 | 9/2009 | Guest et al. | |
| 2009/0283275 | A1 | 11/2009 | Hammer | |
| 2009/0301726 | A1 | 12/2009 | Coronado | |
| 2011/0017469 | A1 | 1/2011 | Malone | |
| 2011/0146975 | A1 | 6/2011 | O'Malley et al. | |

OTHER PUBLICATIONS

Mackay, S. et al.; "Completion Design for Sandface Monitoring of Subsea Wells," SPE 116474, 2008 SPE Annual Technical Conference and Exhibition, Denver, Colorado, Sep. 21-24, 2008, pp. 1-9.

Gambhir, H.S. et al.; "Sensor Architecture for Open Hole Gravel Pack Completions," SPE 116476, 2008 SPE Annual Technical Conference and Exhibition, Denver, Colorado, Sep. 21-24, 2008, pp. 1-10.

Lovell, J. et al.; "Permanent Reservoir Monitoring in Subsea Wells Attains New Level," Journal of Petroleum Technology (JPT), Mar. 2009, pp. 30-33.

* cited by examiner

APPARATUS AND METHOD FOR CONTROLLING FLUID FLOW FROM A FORMATION

BACKGROUND OF THE DISCLOSURE

1. Field of the Disclosure

The disclosure relates generally to an apparatus and method for control of fluid flow between subterranean formations and a production string in a wellbore.

2. Description of the Related Art

To form a wellbore or borehole in a formation, a drilling assembly (also referred to as the "bottom hole assembly" or the "BHA") carrying a drill bit at its bottom end is conveyed downhole. The wellbore may be used to store fluids in the formation or obtain fluids from the formation, such as hydrocarbons. In some cases the wellbore is completed by placing a casing along the wellbore length and perforating the casing adjacent each production zone (hydrocarbon bearing zone) to extract fluids (such as oil and gas) from the associated a production zone. In other cases, the wellbore may be open hole, i.e. no casing. One or more inflow control devices are placed in the wellbore to control the flow of fluids into the wellbore. These flow control devices and production zones are generally separated by packers. Fluid from each production zone entering the wellbore is drawn into a tubular that runs to the surface.

Horizontal wellbores often are completed with several inflow control devices placed spaced apart along the length of the horizontal section. Formation fluid often contains a layer of oil, a layer of water below the oil and a layer of gas above the oil. The horizontal wellbore is typically placed above the water layer. The boundary layers of oil, water and gas may not be even along the entire length of the horizontal well. Also, certain properties of the formation, such as porosity and permeability, may not be the same along the length of the well. Therefore, oil between the formation and the wellbore may not flow evenly through the various inflow control devices. For production wellbores, it is desirable to have a relatively even flow of the oil into the wellbore and also to inhibit the flow of water and gas through the inflow control devices. Passive inflow control devices are commonly used to control flow into the wellbore. Such inflow control devices are set at the surface for a specific flow rate and then installed in the production string, which is then conveyed and installed in the wellbore. Such pre-set passive flow control devices are not configured for downhole adjustments to alter a flow rate. To change the flow rate through such passive inflow control devices, the production string is pulled out to adjust or replace the flow control devices. Such methods are very expensive and time consuming.

SUMMARY

In one aspect, an apparatus for controlling fluid flow between a formation and a tubular is provided, wherein the apparatus includes a retrievable communication device configured to be conveyed to a selected location in the tubular downhole. The apparatus also includes a control node configured to communicate with the retrievable communication device at the selected location, a flow control device coupled to and controlled by the control node and a sensor coupled to the control node, wherein the sensor and flow control device are downhole of the control node.

In another aspect, a method of controlling fluid flow between a wellbore and tubular is provided, wherein the method includes conveying a retrievable communication device downhole in the tubular to a selected location and communicating between the retrievable communication device and a control node at the selected location. The method also includes transmitting a first signal between the control node and a flow control device and transmitting a second signal between the control node and a sensor, wherein the sensor and flow control device are downhole of the control node.

Examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters designate like or similar elements throughout the several figures of the drawing, and wherein.

DETAILED DESCRIPTION OF THE DISCLOSURE

The present disclosure relates to apparatus and methods for controlling flow of fluids in a well. The present disclosure provides certain exemplary drawings to describe certain embodiments of the apparatus and methods that are to be considered exemplification of the principles described herein and are not intended to limit the concepts and disclosure to the illustrated and described embodiments.

Figure 1:
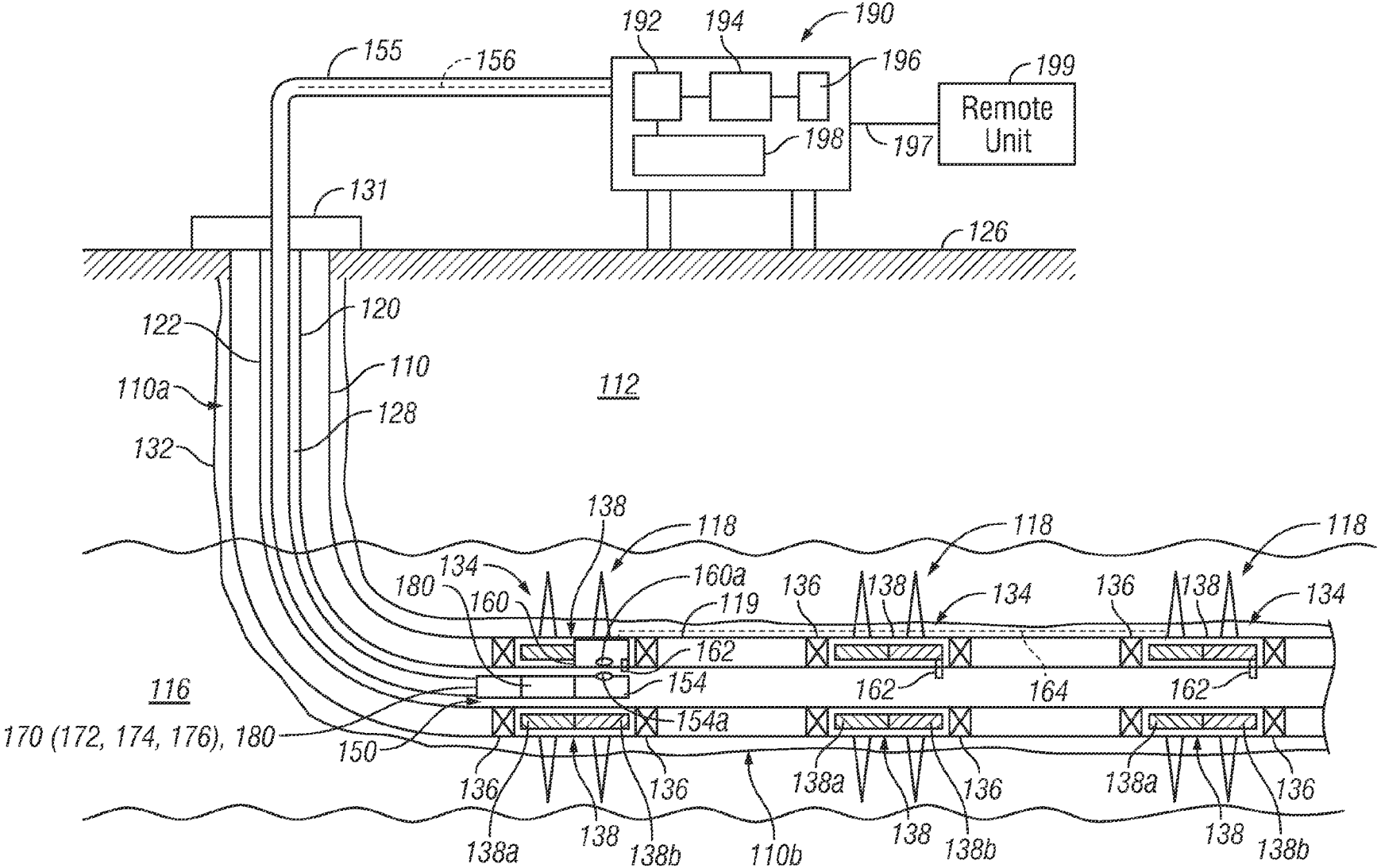
FIG. 1 is a schematic elevation view of an exemplary multi-zone wellbore system that has a production string installed therein, which production string includes one or more flow control devices made according to an embodiment of the disclosure and a retrievable communication device configured to adjust the flow through the flow control devices.

FIG. 1 is a schematic diagram of an exemplary production wellbore system 100 that includes a wellbore 110 drilled through an earth formation 112 and into a production zone or reservoir 116. The wellbore 110 is shown lined with a casing 132 having a number of perforations 118 that penetrate and extend into the production zone 116 so that production fluids may flow from the production zone 116 into the wellbore 110. The exemplary wellbore 110 is shown to include a vertical section 110*a* and a substantially horizontal section 110*b*. The wellbore 110 includes a production string (or production assembly) 120 that includes a tubing (also referred to as the tubular or base pipe) 122 that extends downwardly from a wellhead 124 at the surface 126. The production string 120 defines an internal axial bore 128 along its length. An annulus 130 is defined between the production string 120 and the wellbore casing 113. The production string 120 is shown to include a generally horizontal portion 119 that extends along the deviated leg or section 110*b* of the wellbore 110. Production devices 134 are positioned at selected locations along the production string 120. Optionally, each production device 134 may be isolated within the wellbore 110 by a pair of packer devices 136. Although only two production devices 134 are shown along the horizontal portion 119, any number of such production devices 134 may be arranged along the horizontal portion 119.

Each production device 134 includes a downhole-adjustable flow control device 138 to govern one or more aspects of flow of one or more fluids from the production zones into the production string 120. The downhole-adjustable flow control device 138 may have a number of alternative structural features that provide selective operation and controlled fluid flow therethrough. In one embodiment, the downhole-adjustable flow control device 138 is in communication with a control node 160 configured to communicate signals to determine at least one downhole parameter and adjust a position of the flow control device 138. Thus, the control node 160 may adjust the flow rate and restriction for each flow control device 138 to control fluid production from each production zone 116. The control node 160 is also in communication with sensors 162 configured to determine a parameter of interest downhole, such as properties within the production string 129 and/or wellbore 110. The control node 160 may communicate with flow control devices 138 and sensors 162 using network 164, which may include wireless or wired devices. Wireless communication may be via radio frequency, 802.x protocol, Bluetooth or other suitable devices. Network 164 may also include a conductive wire or fiberoptic cable. The property of interest may be any desired property, including, but not limited to, position of flow control devices 138, flow rate, pressure, temperature, water or gas content in the fluid, resistivity, sound waves, nuclear magnetic resonance, chemical properties, physical properties and optical properties of a fluid downhole. Any suitable sensor may be used to determine the properties of interest, including, but not limited to a flow meter, pressure sensor, temperature sensor, resistivity sensor, acoustic sensor, and nuclear magnetic resonance sensor. Such sensors are known in the art and are thus not described in detail herein. As used herein, the term "fluid" or "fluids" includes liquids, gases, hydrocarbons, multi-phase fluids, mixtures of two of more fluids, water and fluids injected from the surface, such as water. Additionally, references to water should be construed to also include water-based fluids; e.g., brine or salt water. The flow control devices 138 are any suitable device capable of adjusting a flow rate while disposed downhole, wherein a position of the device corresponds to flow rates ranging from no flow (0% open) to open flow (100%) and any position in between (ranging from 0 to 100%).

Still referring to FIG. 1, the embodiment further shows a tool 150 conveyed into the wellbore from the surface location via a suitable conveying member 155, such as a wireline or a tubular (such as a slickline or a coiled tubing). The tool 150 includes a retrievable communication device 154 for communication with control node 160. The tool 150 may further include a controller or control unit 170 that includes a processor 172, such as a microprocessor, a memory or data storage device 174, such as a solid state memory, programs and algorithms 176 accessible to the processor 170 for executing programmed instructions. A telemetry unit 180 provides two-way communication between the downhole tool 150 and a surface controller or control unit 190 via a communication link 156. The surface controller 190 may be a computer-based unit and may include a processor 192, a data storage device 194 and programmed instructions, models and algorithms 196 accessible to the processor. Other peripherals, such as data entry device, display device etc. 198 may be utilized for operating the controller unit 190. The controller 190 may communicate with a remote unit or satellite unit 199, such as placed at an office.

The retrievable communication device 154 may be any device configured to wirelessly communicate with control node 160 downhole. An exemplary retrievable communication device 154 includes an inductive coupling 154*a*. The inductive coupling 154*a* communicates with an inductive coupling 160*a* in control node 160. The inductive couplings 154*a* and 160*a* are configured to communicate a variety of signals, including commands for downhole devices, signals corresponding to sensed parameters, power provided to downhole devices and other signals.

Figure 2:
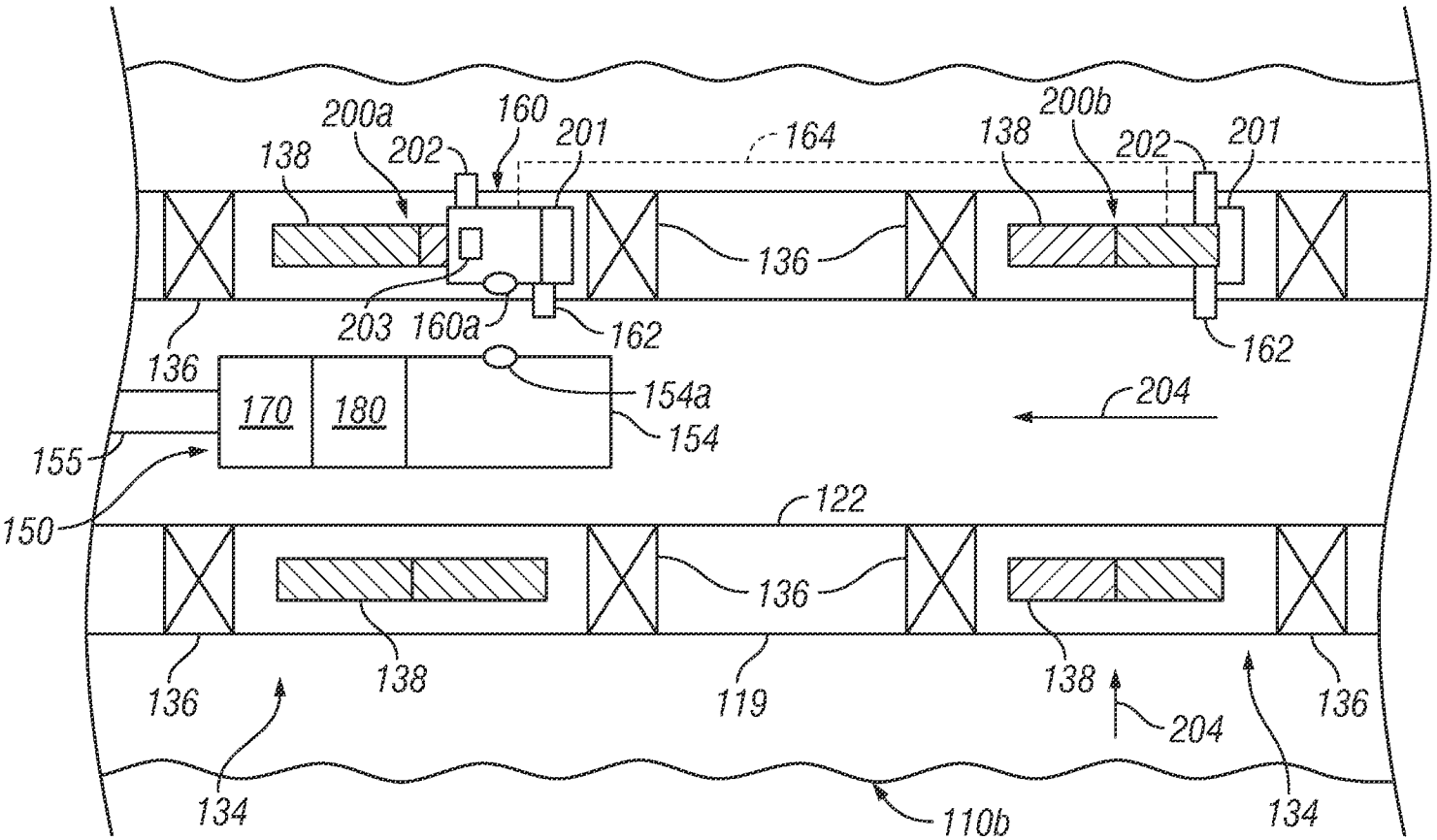
FIG. 2 is a detailed view of a portion of the production string of FIG. 1, including the retrievable communication device and control node.

FIG. 2 is a detailed view of horizontal portion 119 of production string 120. The depicted embodiment includes production devices 134 and control node 160. The control node is conveyed downhole by the conveying member 155, which may include a wireline or slickline. The production device 134 at a first position 200*a* in the production string 120 includes flow control device 138, power source 201, sensor 162 and sensor 202, wherein the production device 134 is operably coupled to and in communication with the control node 160. A second position 200*b* is located downhole of position 200*a*, wherein the production device 134 at 200*b*, wherein the production device 134 includes flow control device 138, power source 201, sensor 162 and sensor 202. In embodiments, a plurality of production devices 134 and downhole equipment are position throughout production string 120, where the control node 160 is configured to communicate with and control the devices and equipment. In an embodiment, the control node 160 is separate from the assembly of the production device 134, wherein the control node 160 controls and is located uphole of a plurality of production devices 134. The control node 160 includes inductive coupling 160*a* and a processing unit 203 that includes a processor, memory or data storage device, programs and algorithms accessible to the processor for executing programmed or received instructions. The inductive coupling 160*a* receives signals from inductive coupling 154*a* of the retrievable communication device 154, wherein signals are received by the processing unit 203. The processing unit 203 then communicates, via network 164, the corresponding commands or functions to flow control devices 138, sensors 162, sensors 202 and other downhole devices. In other embodiments, the signals received by inductive coupling 160*a* are direct commands transmitted, via network 164, to the flow control devices 138, sensors 162 and 202.

Exemplary signals or commands sent to the downhole devices include adjustments to an inflow rate of formation fluid through one or more flow control device 138, wherein the inflow rate is determined by a position of the device. Flow rates may be manipulated based on desired production at a given time as well as characteristics of the formation and formation fluid, which may be known or determined by sensors 162 and 202. Thus, the sensors 162 and 202 communicate signals corresponding to sensed or determined downhole parameters to the retrievable communication device 154 via network 164, optional processing unit 203 and inductive couplings 154*a* and 160*a*. In addition, signals may be communicated from sensors 162 and 202 to retrievable communication device 154, wherein the signals correspond to determined downhole parameters. The determined parameters include flow rate, temperature, pressure, pH and other suitable sensors related to formation fluids and/or downhole conditions. Thus, the determined parameters from sensors 162 and 202 are transmitted, via inductive couplings 160*a* and 154*a*, to the retrievable communication device 154, wherein the device 154 and controller 170 use the parameters to operate downhole devices, such as flow control devices 138. For example, referring to the components at position 200*b*, a decrease in a flow rate of formation fluid 204 is sensed by sensor 202, wherein the flow rate is an input for the retrievable communication device 154 and controller 170, which then determine a substantially open or increased flow position for flow control device 138. Further, a sensed flow rate at position 200*a* is also an input for the device 154 and controller 170, wherein an increased flow rate at position 200*a* leads to a restriction or reduced flow of flow control device at 200*a*. Thus, the retrievable communication device 154 is conveyed downhole to adjust flow rates and balance a flow across the production string 120 to improve production.

In addition, the retrievable communication device 154 and control node 160 provide communication of power signals via inductive couplings 154*a* and 160*a*. For example, the power sources 201 may be rechargeable batteries used to power operation of flow control devices 138 and sensors 162, 202. The retrievable communication device 154 may transmit power signals, via inductive couplings 154*a*, 160*a*, control node 160 and network 164, to recharge power sources 201. In another embodiment without power sources 164, the retrievable communication device 154 provides power to operate flow control devices 138 and sensors 162, 202 when the device 154 is inductively coupled to control node 160. Thus, after and retrievable communication device 154 have adjusted and communicated with flow control devices 138 and sensors 162, 202, the conveying member 155 pulls the tool 150 and retrievable communication device 154 uphole. Accordingly, in the embodiment, the downhole devices are only powered when coupled to the retrievable communication device 154 and are only adjusted when the device 154 is conveyed downhole. The illustrated production system 100 (FIG. 1) includes the temporary inductive coupling of retrievable communication device 154 and control node 160 after the device 154 is conveyed downhole to adjust flow control devices 138 and communicate with sensors 162, 202, thereby improving production of formation fluid. By using the temporary deployable tool 150 and retrievable communication device 154, production of fluids is improved while costs and time to adjust the equipment is reduced. Further, by not having a permanent control line to the surface, overall system complexity, equipment costs and maintenance are also reduced.

The inductive couplings 154*a* and 160*a* include suitable electrical components and devices, such as conductors, in a selected configuration to provide communication between retrievable communication device 154 and control node 160 without a physical connection. Further, the inductive coupling between 154*a* and 160*a* is configured to pass through fluids flowing through production string 120. In an embodiment, inductive coupling 160*a* includes an outer coil that is a solenoid wound inductive coil located in the control node 160. The outer coil is in electric communication with processor unit 203 and other electronics in or proximate control node 160. The inductive coupling 154*a* includes an inner coil that is a solenoid wound inductive coil located in the retrievable communication device 154. In embodiments, the radial distance between the outer coil of inductive coupling 160*a* and the inner coil of inductive coupling 154*a* in a selected axial position of the production string 120 will vary with the rotational orientation of the tool 150 with respect to the production string 120. In addition, electronic signatures, such as RFID devices, may be used to orient the tool 150 and retrievable communication device 154 in the desired location within production string 120. In other embodiments, the rotational position of the tool 150 and retrievable communication device 154 do not affect the inductive coupling with control node 160 once the axial positions of the components are properly aligned.

FIGS. 1-2 are intended to be merely illustrative of the teachings of the principles and methods described herein and which principles and methods may applied to design, construct and/or utilize inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. A method of controlling fluid flow between a formation and a wellbore, the method comprising:
   - conveying a retrievable communication device including a control unit through a tubular to a selected location in the wellbore;
   - obtaining a measurement of a downhole parameter at a downhole sensor included in the tubular;
   - communicating a signal corresponding to the measurement of the downhole parameter from the downhole sensor to the retrievable communication device at the selected location via a downhole control node included in the tubular;
   - determining a control signal in response to the signal corresponding to the measurement of the downhole parameter at the control unit; and
   - communicating the determined control signal from the retrievable communication device to a flow control device included in the tubular via the control node to control the fluid flow between the formation and the wellbore.

2. The method of claim 1, wherein conveying the retrievable communication device comprises conveying the retrievable communication device via one of a wireline or a slickline.

3. The method of claim 1, wherein:
   - conveying the retrievable communication device comprises conveying an inductive coupling device; and
   - communicating signals between the retrievable communication device and the control node comprises inductively transmitting signals between the inductive coupling device and the control node.

4. The method of claim 1 further comprising producing a fluid from the formation while the retrievable communication device is downhole.

5. The method of claim 1, wherein controlling the fluid flow comprises adjusting a position of a flow control device to control a flow rate.

6. The method of claim 1 further comprising communicating between the control node and the retrievable communication device wirelessly via an inductive coupling.

7. The method of claim 1, wherein the downhole parameter is selected from a group consisting of: (i) flow rate; (ii) resistivity; (iii) an acoustic property; (iv) pressure; (v) temperature; (vi) a nuclear magnetic resonance property; (vii) a chemical property of the fluid; (viii) a physical property of the fluid; and (ix) an optical property of the fluid.

8. The method of claim 1, comprising retrieving the retrievable communication device uphole after controlling the fluid flow.

9. An apparatus for controlling a fluid flow rate downhole, comprising:

a retrievable communication device configured to be conveyed downhole to a selected location in a tubular;

a control node included in the tubular at the selected location configured to communicate with the retrievable communication device at the selected location;

a sensor included in the tubular and coupled to the control node configured to provide a signal relating to a downhole parameter to the retrievable communication device via the control node; and a control unit of the retrievable communication device and conveyed downhole with the retrievable communication device, the control unit configured to determine a control signal from the signal relating to the downhole parameter provided by the sensor; and a flow control device included in the tubular and coupled to the control node and configured to receive the control signal from the retrievable communication device via the control node and control the fluid flow rate of the flow control device based on the received control signal, wherein at least one of the sensor and the flow control device are not at the selected location.

10. The apparatus of claim 9, wherein the retrievable communication device is configured to be conveyed downhole via one of a wireline or a slickline.

11. The apparatus of claim 9, wherein the retrievable communication device comprises an inductive coupling device configured to inductively transmit signals to the control node.

12. The apparatus of claim 9, wherein the flow control device is configured to produce a fluid from a formation while the retrievable communication device is downhole.

13. The apparatus of claim 9, wherein the retrievable communication device is configured to be retrieved uphole after controlling the flow rate.

14. The apparatus of claim 9, wherein the control node is located uphole of the at least one of the sensor and the flow control device and communicates with the at least one of the sensor and the flow control device via a network.

15. The apparatus of claim 9, wherein the downhole parameter is selected from the group consisting of: flow rate; resistivity; an acoustic property, pressure, temperature, a nuclear magnetic resonance property, a chemical property of the fluid, a physical property of the fluid; and an optical property of the fluid.

16. The apparatus of claim 9, further comprising a plurality of flow control devices and a plurality of sensors, wherein the control node is configured to communicate with the plurality of flow control devices and the plurality of sensors.

17. An apparatus for controlling a fluid flow rate downhole, comprising:

a control node included in a production string at a selected location configured to inductively communicate with a retrievable communication device including a control unit conveyed through a bore of the production string to the selected location;

a sensor in the production string configured to communicate a downhole parameter to the retrievable communication device via the control node; and a flow control device in the production string configured to receive a control signal from the retrievable communication device via control node to control the fluid flow rate for the flow control device based on the control signal, wherein the control signal is determined at the control unit of the retrievable communication device in response to the communicated downhole parameter.

18. The apparatus of claim 17, wherein the flow control device is configured to produce a fluid from the formation while the retrievable communication device is downhole.

19. The apparatus of claim 17, wherein the retrievable communication device is configured to be deployed downhole temporarily to communicate with the flow control device and sensor.

20. The apparatus of claim 17, wherein the control node comprises an inductive coupling and the retrievable communication device comprises an inductive coupling, wherein the control node and retrievable communication device communicate wirelessly with each other using the inductive couplings.

* * * * *